US006640062B2

(12) United States Patent
Tsubaki et al.

(10) Patent No.: US 6,640,062 B2
(45) Date of Patent: Oct. 28, 2003

(54) TONER IMAGE FIXING DEVICE PROVIDED WITH A SHEET SEPARATING PORTION

(75) Inventors: Yoritaka Tsubaki, Yamatokoriyama (JP); Atsushi Ide, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 288 days.

(21) Appl. No.: 09/753,875

(22) Filed: Jan. 3, 2001

(65) Prior Publication Data

US 2002/0164172 A1 Nov. 7, 2002

(30) Foreign Application Priority Data

Feb. 29, 2000 (JP) ..... 2000-053916

(51) Int. Cl.[7] ..... G03G 15/20
(52) U.S. Cl. ..... 399/44; 399/45; 399/323
(58) Field of Search ..... 399/22, 44, 45, 399/323

(56) References Cited

U.S. PATENT DOCUMENTS 4,332,457 A * 6/1982 Mitsuyama et al. ..... 399/323
5,406,363 A * 4/1995 Siegel et al. ..... 399/323
5,548,389 A * 8/1996 Bowler, Jr. ..... 399/323 X

FOREIGN PATENT DOCUMENTS

JP 63-314582 12/1988

* cited by examiner

*Primary Examiner*—William J. Royer
(74) *Attorney, Agent, or Firm*—Renner, Otto, Boisselle & Sklar, LLP

(57) ABSTRACT

Disclosed is a toner image fixing device that is capable of changeably setting sheet separating portions in contact with or apart from the cylindrical surfaces of corresponding fixing rollers in accord with the resiliency of recording material to surely prevent a recording material from wrapping round the fixing rollers and being jammed between the rollers and capable of minimizing the frequency of contacting the separating portions with the fixing roller surfaces to obtain an increased quality of a toner image fixed on the recording material and elongate the service life of the fixing rollers.

6 Claims, 4 Drawing Sheets

FIG. 3

| HUMIDITY / PAPER | LOW HUMIDITY STATE | NORMAL HUMIDITY STATE | HIGH HUMIDITY STATE |
|---|---|---|---|
| THIN PAPER | CONTACTING POSITION | CONTACTING POSITION | CONTACTING POSITION |
| NORMAL PAPER | DETACHED POSITION | DETACHED POSITION | CONTACTING POSITION |
| THICK PAPER | DETACHED POSITION | DETACHED POSITION | SELECT OF CONTACTING /DETACHED POSITION |
| TRANSPARENT FILM SHEET | DETACHED POSITION | DETACHED POSITION | DETACHED POSITION |

TONER IMAGE FIXING DEVICE PROVIDED WITH A SHEET SEPARATING PORTION

BACKGROUND OF THE INVENTION

The present invention relates to a toner image fixing device for use in an electrophotographic type image forming device such as a copying machine and the like.

Generally, a toner image fixing device for use in an electrophotographic type image forming device is provided with a pair of fixing rollers both of which abut at their cylindrical surface to each other and at least one of which is of a heat roller type incorporating a heater in its body. The heat roller type fixing device is generally such that a toner image developed on a recording material in an image forming step is fixed thereon by heat while the material passes, while being heated, through a nip between the paired fixing rollers, each of which is provided with a separating portion for separating the recording material from the cylindrical surface of the roller, thereby preventing the recording material from adhering to the latter surface.

In this instance, a toner image fixing device for a monochromatic type image forming device uses fixing rollers coated with a Teflon coat having a high strength against mechanical damages, so that the image quality may not be affected by separating portions being always in contact with the cylindrical surface of the rollers.

In contrast, the toner image fixing device for a color type image forming device, in which a color toner image consisting of plural toner layers, being thick and having an uneven surface formed on a recording material, is needed to have fixing rollers having a thick rubber coat capable of fusing and mixing the color toner by sufficiently heating the toner. In other words, the fixing rollers must have a thick rubber layer having a large thermal capacity and tightly covering the uneven surface of the toner image. The thick rubber coated surfaces of the fixing rollers may be damaged if the separating portions are always in contact with the roller surfaces. This results in deterioration of the toner image.

Therefore, a conventional fixing device adopts sheet separating portions capable of being detached from fixing rollers while not forming/fixing a toner image, as disclosed for example in Japanese Laid-Open Patent Publication No. 63-314582, or provides a very small gap between each sheet separating portion and a fixing roller surface.

On the other hand, for a heat roller type fixing device, a fixing roller thermally fixes a toner image developed on a recording material by directly contacting its hot surface with the toner image. Toner particles adhered onto the fixing roller may be undesirably transferred onto a toner image to be fixed on a next recording material.

As such, offset toner is apt to occur in a fixing device of the color type image forming device rather than in a fixing device of the monochromatic type image forming device. This is because the fixing device of the color type image forming device must use fixing rollers with a thick rubber coat having a large heat capacity and covering ability to fuse mixed color toners of a thick and uneven toner developed image consisting of plural toner layers. Such fixing rollers may not possess sufficient release ability due to their thick rubber layer.

For the fixing device of the color type image forming device, the fixing rollers are generally coated with a uniform coat of a release agent (e.g., silicone oil) applied with a coating roller.

By sufficiently applying an anti-offsetting agent to the surface of the fixing rollers, it is realized that a resilient recording material carrying a toner image developed thereon in normal ambient conditions can be easily separated from the fixing rollers even with a sheet separating portion apart from the roller surface.

However, at a humidity considerably higher than a normal humidity level, the recording material may lose its resiliency and not be separated from the fixing roller by the non-contacting sheet separating portions even though the rollers are sufficiently coated with release agent. The recording material may wrap around the fixing roller surfaces. In other words, in the conventional arrangement of the fixing rollers with the separating portions located apart from the roller surface, the recording material in the above condition may not be separated from the separating portions, resulting in jamming it between the fixing rollers.

In the fixing device, where sheet separating portions are used in contact with the fixing roller surfaces while a toner image is formed and fixed on a recording material, oil (anti-offsetting agent) sufficiently applied to the fixing roller may form stripes along the separating portions on the fixing roller surfaces. The oil stripes (contamination with oil) may appear and deteriorate a toner image fixed on a recording material. This contamination is not as visible on usual recording paper but may considerably deteriorate the toner image fixed on a transparent film sheet to be used for an overhead projector. In the latter case, dark stripes appear in the image projected on a screen through the overhead projector since light transmitted through the contaminated portion is reduced by scattering thereat.

SUMMARY OF THE INVENTION

An object of the present invention is to provide a toner image fixing device capable of switching sheet separating portions into contacting positions in which the portions are in contact with corresponding roller surfaces or detached positions at which the portions are apart from corresponding roller surfaces in accordance with a condition of the resiliency of a recording material to surely prevent the recording material from wrapping around the fixing rollers and being jammed between the rollers as well as to reduce the frequency of contacting the separating portions with the surfaces of the corresponding rollers, thereby achieving a high quality toner image fixed on the recording material and extending the service life of the fixing rollers.

Another object of the present invention is to provide a toner image fixing device provided with a sheet separating portion for separating a recording material from a cylindrical surface of a fixing roller, the portion capable of changing its position from a contacting position in which it is in contact with the surface of the fixing roller to a detached position in which it is apart from the surface of the fixing roller and vice versa, a sheet separating portion driving means for turning the sheet separating portion into the contacting position or the detached position and a control means for controlling the sheet separating portion driving means based on, at least, either one of the humidity and the kind of the recording material.

Thus, the separating portion can be turned by the sheet separating portion driving means into its contacting position or detached position in accordance with at least one condition regarding the resiliency of the recording material, i.e., the humidity or the kind of the recording material. This allows the separating portion to be used in contact with the fixing roller surface for separating the recording material from the roller surface merely under the condition that the recording material may easily wrap around the fixing roller and may not depart by itself there from.

Furthermore, the frequency of putting the separating portion into contact with the fixing roller surface is restricted to the case when the recording material may easily wrap around the fixing roller, so the frequency of forming an oil stripe on the roller surface by the separating portion can be minimized, preventing possible deterioration of the toner image fixed on the material, and the possibility of damaging the roller surface by the separating portion can also be reduced, thus extending the service life of the fixing roller.

Another object of the present invention is to provide a toner image fixing device for fixing by heating a toner image formed on a recording material passing through a nip between paired fixing rollers, wherein it is provided with paired sheet separating portions, each portion being capable of changing its position from a contacting position in which it is in contact with a cylindrical surface of the corresponding fixing roller for separating the recording material from the roller surface, to a detached position being apart from the surface of the fixing roller and vice versa, a sheet separation portion driving means for turning the sheet separating portion into the contacting position or the detached position, a humidity sensing means for measuring humidity, a recording material identifying means for identifying the kind of the recording material, and a control means for controlling the sheet separating portion driving means based on, at least, either one of the humidity and the kind of the recording material, which are determined by the humidity sensing means and the recording material identifying means, respectively.

Thus, each separating portion can be turned by the sheet separating portion driving means into its contacting position or detached position on the basis of at least one condition regarding the resiliency of the recording material, i.e., the humidity sensed by the humidity sensing means or the recording material kind determined by the recording material identifying means. This allows the separating portion to be used in contact with the fixing roller surface for separating the recording material from the fixing roller surface merely under the condition that the recording material may easily wrap around the fixing roller and may not depart by itself there from.

Furthermore, the frequency of putting the separating portion into contact with the fixing roller surface is restricted to the case when the recording material may easily wrap around the fixing roller, so the frequency of forming an oil stripe on the roller surface by the separating portion can be minimized, thus preventing possible deterioration of a toner image fixed on the material, and the possibility of damaging the roller surface by the separating portion can also be reduced, thereby extending the service life of the fixing roller.

Another object of the present invention is to provide a toner image fixing device wherein a control means controls sheet separating portion driving means to turn corresponding separating portions into contacting positions under a condition that the recording material is identified as thin paper by the material identifying means. In this case, the thin paper being weak in resiliency is surely prevented from wrapping around any fixing rollers regardless of the humidity.

A further object of the present invention is to provide a toner image fixing device wherein a control means controls sheet separating portion driving means to turn corresponding separating portions into detached positions under the condition that a recording material is identified as thick paper (i.e., thick paper being thicker than normal recording paper and not easily wrapping around the surface of a fixing roller) by a recording material identifying means and a humidity lower than a normal humidity is detected (i.e., at which the paper may not wrap around the fixing roller), by a humidity sensing means. In this case, the frequency of contacting the sheet separating portions with the surfaces of the corresponding fixing rollers and the possibility of damaging their surfaces by the separating portion is minimized, thereby assuring extended service life of the fixing rollers.

A still further object of the present invention is to provide a toner image fixing device wherein a control means controls sheet separating portion driving means to turn separating portions into contacting positions under the condition that a recording material is identified as normal recording paper by a recording material identifying means and a humidity higher than a normal humidity is detected by a humidity sensing means. In this case, since the recording paper of a normal thickness may reduce its strength (resiliency) at a high humidity and therefore may easily wrap around one of the fixing rollers, the sheet separating portions are used in contact with the surfaces of the fixing rollers to surely separate the paper from the roller surfaces. In contrast, the sheet separating portions are kept apart from the fixing rollers at a normal humidity. This reduces the frequency of contacting the sheet separating portions with the fixing roller surfaces and therefore minimizes the possibility of damaging the surfaces of the fixing rollers by the sheet separating portions, thereby extending the service life of the fixing rollers.

Another object of the present invention is to provide a toner image fixing device wherein a control means is capable of controlling selectively the sheet separating portion driving means to turn each separating portion into a contacting or detached position under the condition that a recording material is identified as thick paper thicker than a normal recording paper by a recording material identifying means and a humidity higher than a normal humidity is detected by a humidity sensing means. In this case, since the thick recording paper has a high strength (resiliency) in a normal state but may reduce its strength at a high humidity and therefore may wrap around one of the fixing rollers, the selection is left for a user to turn the sheet separating portions into their contacting positions or detached positions by the user's preference (for example, the detached position is selected to keep the quality of the fixed toner image and contacting position is selected to eliminate the possibility of jamming of the fixing process at the sacrifice of the quality of the fixed toner image). In practice, it is left for the user to select when to put the portion into the contacting position or to keep the portion in the detached position under the condition that the paper is thick and the humidity is high. This feature may satisfy the user's demand.

A further object of the present invention is to provide a toner image fixing device wherein a control means controls sheet separating portion driving means to turn separating portions into detached positions under the condition that a recording material identifying means identifies a recording material as a transparent film sheet to be used in an overhead projector. In this case, since the transparent film sheet may be less affected by humidity and has a high strength in comparison with recording paper, there is no fear of breaking the fixing process with the sheet jammed between fixing rollers without using the sheet separating portions.

This eliminates the possibility of deteriorating the fixed toner image with stripes of contamination oil formed by the separating portions on the fixing rollers.

BRIEF DESCRIPTION OF THE DRAWINGS

FIG. 3 illustrates sheet separating portions turned into positions for contacting with or positions apart from a fixing roller under the control of a separating portion control portion.

PREFERRED EMBODIMENTS OF THE PRESENT INVENTION

Referring to the accompanying drawings, preferred embodiments of the present invention will be described below.

A toner image fixing device embodying the present invention is described as incorporated in an electrophotographic type digital color copier (image forming apparatus).

Figure 1:
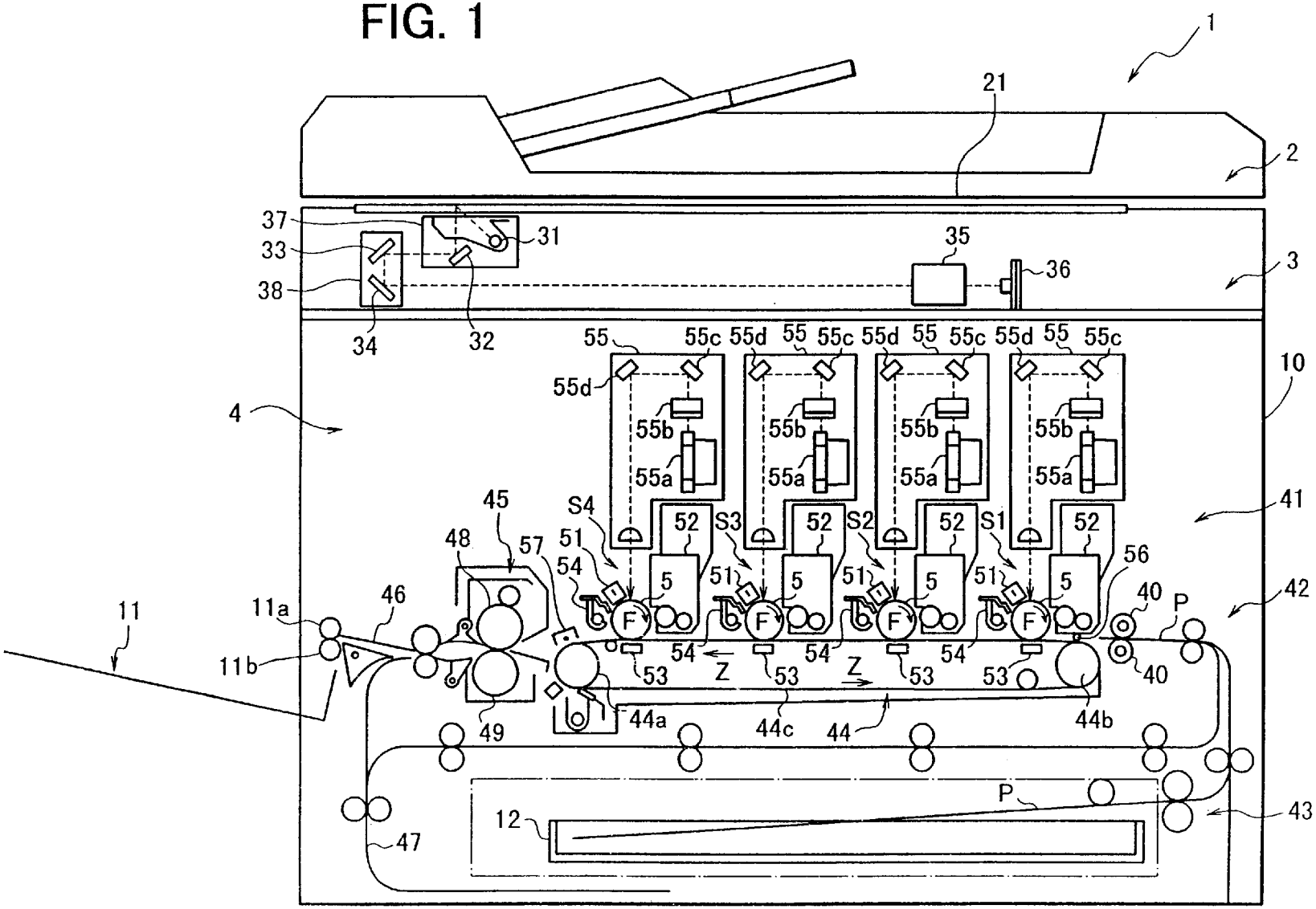
FIG. 1 is a front sectional view of a digital color copier provided with a toner image fixing device according to the present invention.

A whole system of the digital color copier:

FIG. 1 is a schematic front sectional view of a digital color copier 1. As shown in FIG. 1, the digital color copier 1 is provided with a recirculating automatic document feeder (RADF) portion 2, an image reading portion 3 and an image forming portion 4, each of which will be described below in detail.

[Recirculating Automatic Document Feeder (RADF) Portion 2]

The recirculating automatic document feeder 2 is disposed on the top of a document table 21 made of a transparent glass. It can be opened and closed with respect to the document table 21 and is mounted in a given position relative to the document table. The document feeder (RADF) 2 is designed to feed an original document sheet to the document table 21 in such a manner that one side (e.g., the top surface) of the original is placed on a given position of the document table 21 opposite to the image reading portion 3. On completion of reading that side of the original by the image reading portion 3, the document feeder 2 turns over the original and feeds it again to the given position of the document table 21 to place the other side (e.g., the rear surface) of the original document opposite to the image reading portion 3. When images on both surfaces of the original were read, the document feeder 2 delivers the original out of the main body and, then, begins feeding of a next original to the document table 21. The above document feeding and reversing operations are controlled in accordance with an entire system operation of the digital color copier 1.

[Image Reading Portion 3]

The image reading portion 3 is intended to read an image from an original put on the document table 21 to form image data of originals transported one by one to the document table 21 by the document feeder 2. The image reading portion 3 is disposed below the document table 21 in the upper part of the digital color copier 1. The image reading portion 3 includes an illuminating light source 31, first, second and third reflecting mirrors 32, 33 and 34, an image forming optical lens 35 and a photoelectric converting element 36. In this case, the illuminating light source 31 and the first reflecting mirror 32 compose a first scanning unit 37, while the second and third reflecting mirror 33 and 34 compose a second scanning unit 38.

The light source 31 illuminates an image of an original transported in the RADF portion 2 and put on the document table 21 thereof. The mirrors 32, 33 and 34 are arranged so that a light reflected image from the original image is reflected first in a given direction (leftward in FIG. 1) and then downward and finally directed to the optical image forming lens 35 along light path shown by broken lines.

The first scanning unit 37 (composed of the light source 31 and the reflecting mirror 32) can reciprocally travel at a specified speed in a horizontal direction (from left to right and reverse in FIG. 1) along the bottom surface of the document table 21, keeping a constant distance from the bottom surface thereof. The second scanning unit 38 (composed of the second and third reflecting mirrors reciprocally travels parallel with the first scanning unit 37 keeping a constant speed relative to the speed of the first scanning unit 37.

The image forming optical lens 35 reduces the size of the original image light reflected from the third reflecting mirror 34 of the second scanning unit 38 and focuses the light of the contracted image at a given position on the photoelectric converting element 36.

The photoelectric converting element 36 photoelectrically converts focused light of the image into a series of output electrical signals. The photoelectric converting element 36 is a three line color charge coupled device (CCD) which can read a monochromatic image or a color image, decompose it to color components R(Red), G(Green) and B(Blue) and output the data of three lines. The series of electrical signals representing the original image information is further transferred from the photoelectric converting element 36 to an image processing unit (not shown) for further necessary processing.

[Image Forming Portion 4]

The image forming portion 4 is provided with an image forming system 41 and a sheet transfer system 42.

The image forming system 41 is disposed in the upper portion of the body 10 in the digital color copier 1 and is provided in its lower portion with a paper feeding mechanism 43 that feeds separately a sheet of copy paper (recording material) P from a pile of paper sheets on a paper tray 12 to the image forming system 41. A separate paper sheet P (cut sheet) is transported to the image forming system 41 under timing control by a pair of (upper and lower) register rollers 40 disposed close to an inlet of the image forming system 41 (on the right hand in FIG. 1). The paper sheet P having an image formed on one side is transported again to the image forming system 41 in accordance with the timing control of the image output unit.

In the middle portion of the body 10 in the digital color copier 1, a transfer belt device 44 is disposed under the image forming system 41. The transfer belt device 44 comprises an endless transfer belt 44*c* engagingly stretched between a driving roller 44*a* on one side (left in FIG. 1) and a driven roller 44*b* on the other side (right in FIG. 1), which belt is driven in the direction shown by an arrow Z in FIG. 1. The paper sheet P is fed by the register rollers 40 onto the transfer belt 44*c* by which it is further transported from the upstream side to the downstream side, being stably held thereon by the action of electrostatic force.

A toner image fixing device 45 for fixing a toner image formed on the paper sheet P is arranged on the downstream side (left in FIG. 1) of the transfer belt device 44. The toner image transferred and formed on the paper sheet P is fixed thereon by heating while passing a nip between fixing rollers 48, 49 (described later) of the fixing device 45. The fixing device 45 is further provided at its downstream end with switching gate 46 that selectively switches a path from the fixing device 45 to: a path for delivering the paper sheet P by a pair of outlet rollers 11*a*, 11*b* to an outlet tray 11 attached to the external wall of the body 10 or a path for returning it through the lower portion of the transfer belt device 44 to the image forming system 41. The path for returning the paper sheet P is provided with a switchback transporting device 47. The paper sheet P fed by the switching gate 46 to the returning path is reverse directed with its rear edge forward by the switchback transporting device 47 toward the image forming system 41.

In the image forming section 41, image forming stations No. 1(S1), No. 2(S2), No. 3(S3) and No. 4(S4) are arranged in parallel to each other and closely above the transfer belt 44*c* in the described order from the upstream side (right in FIG. 1) of the sheet transferring path. In this instance, the paper sheet P on the transfer belt 44*c* is transported to the image forming stations S1–S4 sequentially.

The image forming stations S1–S4 have substantially the same structure including a light sensitive drum 5 that can rotate in the direction shown by arrows F in FIG. 1. Each light sensitive drum 5 is surrounded by a charger 51 for evenly charging a working surface of the light sensitive drum 5, a developing device 52 for developing with toner a latent image formed on the surface of the light sensitive drum 5, a transfer discharger 53 for transferring the developed toner image (visible image) onto a paper sheet P and a cleaning device 54 for scrapping off toner remaining on the drum surface.

The above devices are arranged around the light sensitive drum 5 in the described order in the rotational direction (shown by arrows F) of the light sensitive drum 5.

Above each light sensitive drum 5 is a laser beam scanner unit (referred hereinafter to as LSU) 55, which is composed of a semiconductor laser element (not shown) for generating dot light modulated according to image data, a polygonal mirror (deflecting device) 55*a* for deflecting a laser beam from the semiconductor laser element in the main horizontal scanning direction, a lens f 0 55*b* and mirrors 55*c*, 55*d* for forming an image on a surface of the light sensitive drum 5.

The LSU 55 of the first image forming station S1 receives an image signal corresponding to a black color image component of an original color image, the LSU 55 of the second image forming station S2 receives an image signal corresponding to a cyan color image component, the LSU 55 of the third image forming station S3 receives an image signal corresponding to a magenta color image component and the LSU 55 of the fourth image forming station S4 receives a yellow color image component. As a result, latent images corresponding to color converted image information of an original image are formed on the external cylindrical surfaces of respective light sensitive drums 5.

The developing device 52 of the first image forming station S1 stores black toner, the developing device 52 of the second image forming station S2 stores cyan color toner, the developing device 52 of the third image forming station S3 stores magenta color toner and the developing device 52 of the fourth image forming station S4 stores yellow toner. The latent images formed on the respective light sensitive drums 5 are developed with toner from the respective developing devices 52 (the respective color). The original image information is converted by the image forming system 41 into color component images that are thus reproduced as respective color component images by the respective developing devices 52.

A charger 56 is disposed between the first image forming station S1 and the paper feeding mechanism 43 and electrically charges the surface of the transfer belt 44*c*. The paper sheet P is fed by the paper feeding mechanism 43 and persistently adheres to the transfer belt 44*c* by the effect of electrostatic force and is reliably transported by the transfer belt 44*c* through the first to fourth image forming stations S1–S4.

A discharger 57 is disposed just above the driving roller 44*a* of the transfer belt 44*c* between the fourth image forming station S4 and the fixing device 45. The discharger 57 is supplied with an alternating current to separate the paper sheet P from the transfer belt 44*c*.

In the above described digital color copier 1, a paper sheet P is fed from a paper tray 12 into a guide of a paper transporting path of the paper feeding mechanism 43 and its front edge is detected by a (not shown) sensor that in turn generates a detection signal to paired register rollers 40 for temporally stopping the paper sheet P. The paper sheet P is then sent onto the transfer belt 44*c* rotating in the direction shown by arrow Z in FIG. 1 in synchronism with the operation of the image forming stations S1–S4. Since the transfer belt 44*c* is electrically charged by the charger 56, the paper sheet P is stably transported by the transfer belt while passing through the image forming stations S1–S4.

At the image forming stations (S1–S4), the respective color toner images are subsequently transferred onto the paper sheet P adhering to the transfer belt 44*c*. On completion of transferring the last toner image at the fourth image forming station S4, the paper sheet P is separated from the transfer belt 44*c* by the action of the discharger 57 and fed to the toner image fixing device 45. The paper sheet P with the color image fixed by heat thereon is delivered through a paper outlet (not shown) onto the outlet tray 11 by outlet rollers 11*a*.

Figure 2:
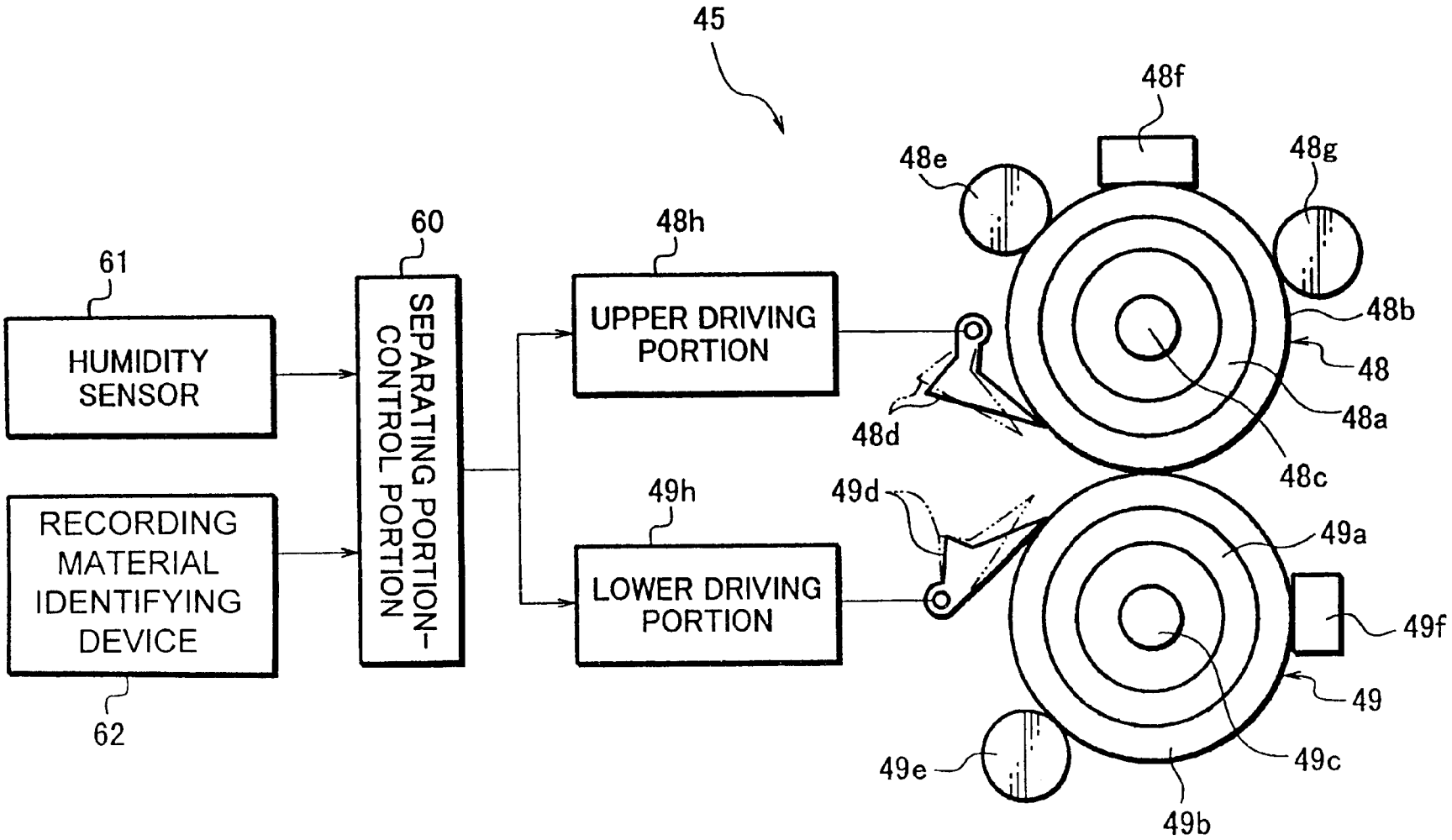
FIG. 2 is a block diagram of a toner image fixing device.

The toner image fixing device 45 of the present invention is provided with an upper fixing roller 48 and a lower fixing roller 49, which are disposed with their working surfaces pressed against each other as shown in FIG. 2. Each of the upper and lower fixing rollers 48 and 49 is composed of an aluminum core cylinder 48*a*(49*a*) covered with a silicone rubber layer 48*b*(49*b*), in which a heater 48*c*(49*c*) composed of a halogen lamp is incorporated.

The upper fixing roller 48 is surrounded by an upper sheet separating portion 48*d*, an upper cleaning roller 48*e*, an upper roller temperature sensor 48*f* for measuring a surface temperature of the fixing roller 48 and an oil applying roller (rotary member) 48*g*. The lower fixing roller 49 is surrounded by a lower sheet separating portion 49*d*, a lower cleaning roller 49*e* and a lower roller temperature sensor 48*f* for measuring a surface temperature of the lower fixing roller 49.

The upper and lower cleaning rollers 48*e* and 49*e* are felt covered rollers being in contact with respective fixing rollers 48 and 49 to recover offset toner from the roller surfaces. The oil applying roller 48*g* is covered with a rubber layer for applying silicone oil (anti-offset agent) to the surface of the upper fixing roller 48. The upper and lower roller temperature sensors 48*f* and 49*f* are composed each of a thermistor type sensor capable of contacting with a relevant fixing roller surface and measuring a temperature thereof. The surface temperatures of the fixing rollers 48 and 49, measured by the temperature sensors 48*f* and 49*f*, are output to a fixing operation control portion (not shown). The control portion controls the operation of a power supply unit to maintain the surface temperatures of the fixing rollers 48 and 49 at a constant specified value by turning ON and OFF the roller heaters 48*c* and 49*c* according to the temperature detecting signals from the temperature sensors 48*f* and 49*f*.

The upper and lower sheet separating portions 48*d* and 49*d* are arranged in such a way that they may be pressed at their top edges against the corresponding fixing roller surfaces in one (contacting) position (shown by a continuous line in FIG. 2) and apart from the corresponding roller surfaces in the other (detached) position (shown a two dot chain line in FIG. 2). In the contacting position, the portions 48*d* and 49*d* separate the paper sheet P from the surfaces of the fixing rollers 48 and 49, respectively. The portions 48*d* and 49*d* are connected to upper and lower driving portions 48*h* and 49*h*, respectively, which drive the corresponding portions into the contacting positions or detached positions according to an instruction from a separating portion-control portion 60 to which a humidity sensor 61 for sensing the humidity and a recording material identifying device 62 for determining the kind of a paper sheet P are connected to receive signals from the humidity sensor 61 and the recording material identifying device 62. The separating portion-control portion 60 controls the driving portions 48*h* and 49*h* of the separating portions 48*d* and 49*d* according to, at least, either one of inputs from the humidity sensor 61 and the recording material identifying device 62. The recording material identifying device 62 may be of the type that identifies the thickness of the paper sheet P by light transmitted through or reflected from the paper, or identifies the type of the paper sheet P by information previously input by a user or, if a plurality of paper feeding trays are used for supplying different kinds of paper, identifies the type of the paper sheet P by detecting the tray from which the paper sheet P was fed. In this case, the separating portions 48*d* and 49*d* in the detached positions may be apart at a distance of about 1 mm from the surface of the respective fixing rollers 48 and 49.

Referring to FIG. 3, the operating conditions of the separating portion control portion 60 for bringing each of the separating portions 48*d*, 49*d* into its contacting position or detached position according to at least either one of inputs from the humidity sensor 61 and the recording material identifying device 62 will be described below in detail.

In the digital color copier 1, the humidity sensor 61 is set to detect three ranges of humidity, i.e., a normal humidity range of about 20 to 80%, a low humidity range of less than 20%, and a high humidity range of greater than 80%.

The recording material identifying device 62 is set to detect three classes of thickness of the paper sheets P, i.e., a normal paper range of 75 to 105 g/m2, a thin paper range of less than 75 g/m2 and a thick paper range of greater than 105 g/m2.

As shown in FIG. 3, the separating portion-control portion 60 causes the separating portions 48*d* and 49*d* to turn into the respective contacting positions under the condition when the paper sheet P was recognized as thin paper and the humidity was determined in the low range, while it causes the separating portions 48*d* and 49*d* to turn into the detached positions under the condition when the paper sheet P was recognized as thick paper and the humidity was determined in the low range and causes the separating portions 48*d* and 49*d* to turn into the contacting positions under the condition when the paper sheet P was recognized as normal paper and the humidity was determined in the high range. Furthermore, under the condition when the paper sheet P was recognized as thick paper and the humidity was determined in the high range, the separating portion control portion 60 causes the separating portions 48*d* and 49*d* to turn into the contacting positions or the detached positions. In case when the paper sheet P was determined as a transparent film sheet to be used for overhead projection, the separating portion control portion 60 causes the separating portions 48*d* and 49*d* into the detached positions.

Figure 4:
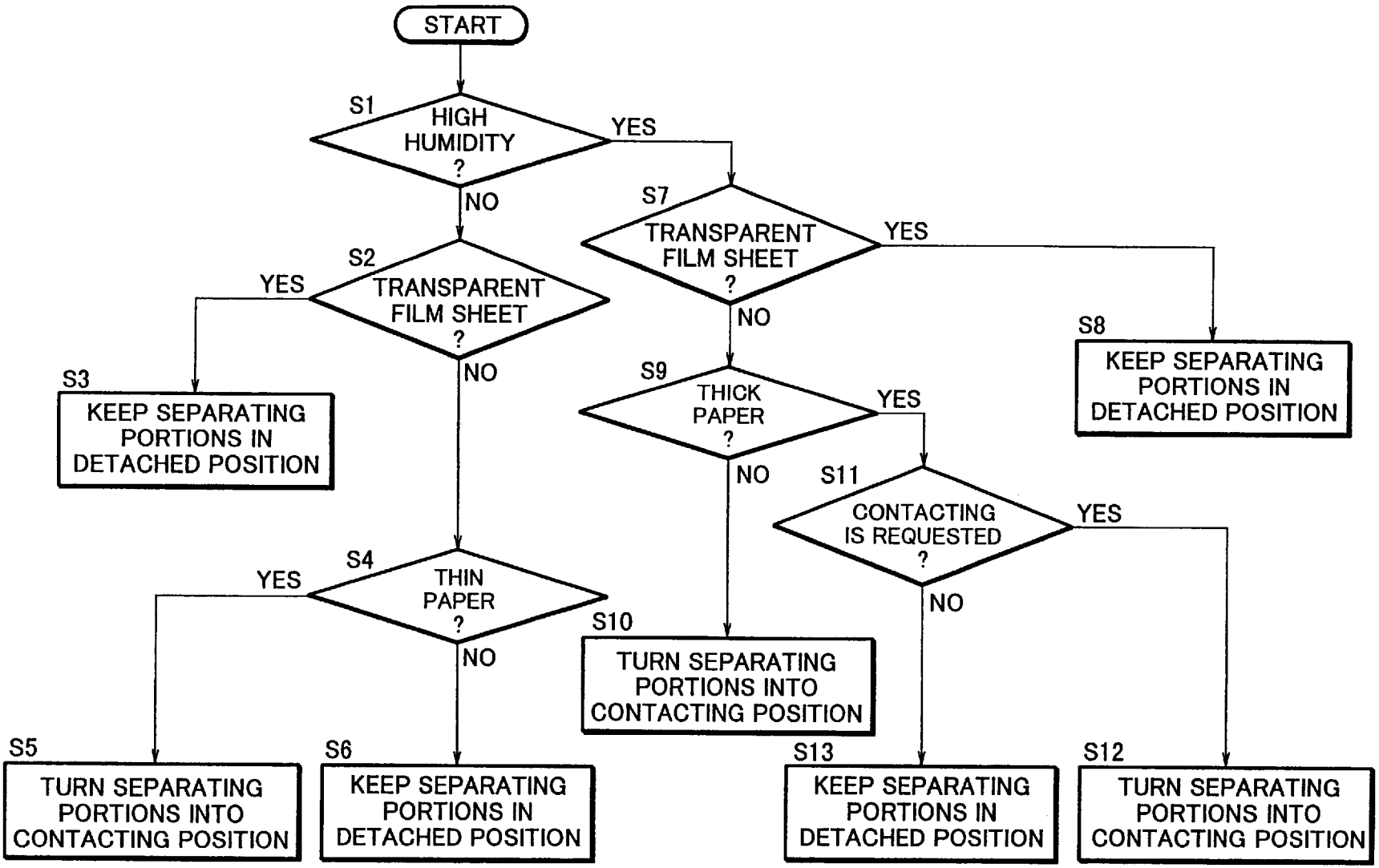
FIG. 4 is a flowchart illustrating the operation of a sheet separating portion control for turning each sheet separating portion into a position contacting with or a position apart from a fixing roller surface.

The operation of each of the separating portions 48*d* and 49*d* under the control of the separating portion control portion 60 will be described below with reference to the flowchart of FIG. 4. In this instance, assume that each of the separating portions 48*d* and 49*d* is now set in the detached position (shown by a two dot chain line in FIG. 2).

The control starts and proceeds to Step S1 in which it queries whether the humidity detected by the humidity sensor 61 indicates the high humidity exceeding 80%. If it is not high, but normal (not more than 80%) or low, i.e., the query in Step S1 is negatively answered, then the control proceeds to Step S2 in which it queries whether the paper sheet P is recognized by the recording material identifying device 62 as a transparent film sheet to be used for an overhead projector.

If the query is positively answered (i.e., the sheet P is the transparent film sheet), then the control proceeds to Step S3 in which it leaves the separating portions 48*d* and 49*d* in the detached positions without causing the driving portions 48*h* and 49*h* to drive the respective portions. If the query is negatively answered (i.e., the sheet P is not a transparent film sheet), then the control proceeds to Step S4 in which it queries whether the sheet P is thin paper whose thickness is not more than 75 g/m2.

If the query in Step S4 is positively answered (i.e., the sheet P is thin paper), then the control proceeds to Step S5 in which it causes the driving portions 48*h* and 49*h* to turn the separating portions 48*d* and 49*d* into the contacting positions (as shown by continuous lines in FIG. 2). If the query is negatively answered (i.e., the sheet P is not thin paper), then the control proceeds to Step S6 in which it keeps the separating portions 48*d* and 49*d* in the detached positions without driving the driving portions 48*h* and 49*h*.

If the query in step Si is positively answered (i.e., the humidity is higher than 80%), then the control proceeds to Step S7 in which it further queries whether the paper sheet P is recognized by the recording material identifying device 62 as a transparent film sheet to be used for an overhead projector.

If the query in Step S7 is positively answered (i.e., the sheet P is the transparent film sheet), then the control proceeds to Step S8 in which it keeps the separating portions 48*d* and 49*d* in the detached positions without driving the driving portions 48*h* and 49*h*. If the query in Step S7 is negatively answered (i.e., the sheet P is not a transparent film sheet), then the control proceeds to Step S9 in which it queries whether the sheet P recognized by the recording material identifying device 62 is thick paper whose thickness exceeds 105 g/m2.

If the query in Step S9 is negatively answered (i.e., the sheet P is not thick paper), then the control proceeds to Step S10 in which it causes the driving portions 48*h* and 49*h* to turn the separating portions 48*d* and 49*d* into the contacting positions. If the query in Step S9 is positively answered (i.e., the sheet P is thick paper), then the control proceeds to Step S11 in which it further queries whether the driving portions 48*h* and 49*h* are set to turn the separating portions 48*d* and 49*d* into the contacting positions.

If the query in Step S11 is positively answered (it is requested to set the driving portions 48*h* and 49*h* to turn the separating portions 48*d* and 49*d* into the contacting positions), then the control proceeds to Step S12 in which it causes the driving portions 48*h* and 49*h* to turn the separating portions 48*d* and 49*d* into the contacting positions. If the query in Step S11 is negatively answered (i.e., there is no need of setting the driving portions 48*h* and 49*h* to turn the separating portions 48*d* and 49*d* into the contacting positions), then the control proceeds to Step S13 in which it keeps the separating portions 48*d* and 49*d* in the detached positions without driving the driving portions 48*h* and 49*h*.

Thus, in this embodiment, the separating portions 48*d* and 49*d* are turned into the contacting positions or the detached positions by the driving portions 48*h* and 49*h*, respectively, according to, at least, either one of conditions regarding the resiliency of the paper sheet P, i.e., the humidity or the kind of the paper. This enables the fixing device 45 to use the separating portions 48*d* and 49*d* in contact with the cylindrical surfaces of the fixing rollers 48 and 49 only in the state in which the paper sheet P may be likely jammed between the upper and lower fixing rollers 48 and 49. In practice, merely in cases of fixing a toner image developed on thin paper, excepting the transparent film sheet, at the normal or low humidity, or a toner image developed on normal or thin paper at the high humidity or a toner image developed on thick paper desired to be surely separated by use of the separating portions 48*d* and 49*d*, it is allowed to use the separating portions 48*d* and 49*d* in contact with the surfaces of the fixing rollers 48 and 49 respectively for preventing the paper sheet P from wrapping around the fixing rollers 48 or 49.

In addition, the frequency of contacting the separating portions 48*d* and 49*d* with the surfaces of the fixing rollers 48 and 49 respectively is restricted to such cases that the paper sheet P may easily wrap around the fixing rollers 48 or 49. This reduces the possibility of forming oil stripes on the surfaces of the fixing rollers 48 and 49 by the separating portions 48*d* and 49*d* contacting therewith and, at the same time, minimizes the possibility of damaging the surfaces thereof. In other words, deterioration of the toner image fixed on the paper sheet P can be prevented and, at the same time, the service life of the fixing rollers 48 and 49 can be extended.

Furthermore, the separating portion control portion 60 can control the upper and lower driving portions 48*h* and 49*h* to turn the separating portions 48*d* and 49*d* into the contact positions or detached positions by user's selection under the condition that the recording material is identified as thick paper thicker than the normal recording paper by the recording material identifying device 62 and the humidity higher than the normal humidity is detected by the humidity sensor 61. In this instance, the thick recording paper has a high strength (resiliency) in the normal state but may reduce its strength at a high humidity and wrap around one of the fixing rollers 48 and 49. Namely, it is previously selected by the user to use the sheet separating portions 48*d* and 49*d* apart from or in contact with the surfaces of the corresponding fixing rollers 48 and 49 in accordance with the actual conditions and preference (e.g., for improving the fixed toner image quality or for eliminating the possibility of jamming of the fixing process at the sacrifice of the quality of the fixed toner image). This feature satisfies the user's request.

Furthermore, the separating portion control portion 60 can also control the upper and lower driving portions 48*h* and 49*h* to turn the separating portions 48*d* and 49*d* into detached positions under the condition that a recording material identifying device 62 identifies the paper sheet P as a transparent film sheet to be used in an overhead projector. Since the transparent film sheet may be less effected by the humidity and has higher strength in comparison with recording paper, it may not wrap around fixing rollers 48 or 49 with no risk of breaking the fixing process with the sheet separating portions 48*d* and 49*d* left in the detached positions. This eliminates the possibility of forming oil stripes on the fixing rollers 48 and 49 by the separating portions 48*d* and 49*d*, improving the fixed toner image on the recording material.

Although the embodiments have been described above with control of the separating portions 48*d* and 49*d* relative to the surfaces of the corresponding fixing rollers 48 and 49, it should be understood that the control can be applied to a single separating portion relative to one of paired fixing rollers.

As is apparent from the foregoing, a toner image fixing device according to the present invention offers the following advantages:

Each separating portion can be turned by the driving means into its contacting position or detached position on the basis of at least one condition regarding the resiliency of the recording material, i.e., the humidity or the kind of the recording material. This allows the separating portion to be in contact with the fixing roller surface for surely separating the recording material from the fixing roller surface merely under the condition that the recording material may easily wrap around the fixing roller. Furthermore, the frequency of putting the separating portion into contact with the fixing roller surface is restricted to such a case when the recording material may easily wrap around the fixing roller, so the frequency of forming oil stripes on the roller surface by the separating portion can be minimized, preventing possible deterioration of the toner image fixed on the recording material. The possibility of damaging the roller surface by the separating portion can also be minimized, thereby extending the service life of the fixing roller.

In particular, each separating portion can be turned by the driving means into the contacting or detached position under the control based on at least one condition regarding the resiliency of the recording material, i.e.. the humidity sensed by the humidity sensor or the kind of the recording material recognized by the recording material identifying device. This allows the separating portions to contact the corresponding roller surfaces for surely separating the recording material from the fixing roller surfaces merely under the condition that the recording material may easily wrap around the fixing roller, thereby improving the image quality and extending the service life of the fixing rollers.

In particular, thin paper being weak in resiliency is surely prevented from wrapping around the fixing rollers by previously turning the separating portions into the contact positions under the condition that the recording material is identified as thin paper regardless of the humidity.

In particular, separating portions can be turned into detached positions under the condition that the recording material is identified as thick paper and the humidity is determined to be low. Therefore, the frequency of contacting the sheet separating portions with the surfaces of the fixing rollers is reduced and the possibility of damaging their surfaces by the separating portion is minimized, thereby assuring the extended service life of the fixing rollers.

By turning the separating portions into their contacting positions under the condition that the recording material is identified as normal recording paper and the humidity is recognized to be high, it is possible to surely prevent the normal recording paper from wrapping around one of the fixing rollers at a high humidity at which the paper may reduce its strength. In contrast, the sheet separating portions are kept apart from the fixing rollers at normal humidity.

This reduces the frequency of contacting the sheet separating portions with the surfaces of the corresponding fixing roller and therefore minimizes the possibility of damaging the surfaces of the fixing rollers by the sheet separating portions, thereby extending the service life of the fixing rollers.

In particular, a control means controls portion driving means to turn each separating portion into its contacting or detached position by the user's selection under the condition that the recording material is identified as thick paper and the humidity is high. In this instance, the user can select to turn the sheet separating portions into the contacting positions or keep them in the detached positions by his preference for, e.g., keeping the quality of the fixed toner image or eliminating the possibility of jamming of the recording paper between the fixing rollers.

By turning the separating portions into the detached positions under the condition that the recording material is identified as a transparent film sheet to be used in an overhead projector, it is possible to prevent breaking the toner image fixing process due to the jamming of the transparent film sheet that maybe less effected by the humidity and has a high strength in comparison with recording paper. It is also possible to improve the fixed toner image quality with no oil stripe contamination.

What is claimed is:

1. A toner image fixing device provided with a sheet separating portion for separating a recording material from a cylindrical surface of a fixing roller, the sheet separating portion capable of changing position from a contacting position in which the sheet separating portion is in contact with the surface of the fixing roller to a detached position in which the sheet separating portion is apart from the surface of the fixing roller and vice versa, a sheet separating portion driving means for turning the sheet separating portion into the contacting position or the detached position and a control means for controlling the sheet separating portion driving means based on, at least, either one of a humidity and a kind of recording material, wherein the sheet separating portion driving means turns the sheet separating portion into the contacting position in which it is in contact with the surface of the fixing roller when a paper sheet is thin.

2. A toner image fixing device for fixing by heating a toner image formed on a recording material passing through a nip between paired fixing rollers, wherein the toner image fixing device is provided with paired sheet separating portions, each sheet separating portion being capable of changing position from a contacting position in which the sheet separating portion is in contact with a cylindrical surface of the corresponding fixing roller for separating the recording material from the cylindrical surface, to a detached position being apart from the cylindrical surface of the fixing roller and vice versa, a sheet separating portion driving means for turning the sheet separating portion into the contacting position or the detached position, a humidity sensing means for measuring humidity, a recording material identifying means for identifying a kind of recording material, and a control means for controlling the sheet separating portion driving means based on, at least, either one of the humidity and the kind of the recording material, which are determined by the humidity sensing means and the recording material identifying means, respectively, wherein the control means controls the sheet separating portion driving means to turn the sheet separating portions into the contacting positions in which they are in contact with the corresponding fixing roller surfaces on condition that the kind of the recording material is thin paper determined by the recording material identifying means.

3. A toner image fixing device as defined in claim 2, wherein the control means controls the sheet separating portion driving means to turn the sheet separating portions into the detached positions in which they are apart from the corresponding fixing roller surfaces on condition that the kind of the recording material is discriminated as a paper sheet thicker than a normal paper sheet by the recording material identifying means and the humidity determined by the humidity sensing means is lower than a normal humidity value.

4. A toner image fixing device as defined in claim 2, wherein the control means controls the sheet separating portion driving means to turn the sheet separating portions into the contacting positions for contacting with the corresponding fixing roller surfaces on condition that the kind of the recording material determined by the recording material identifying means is a normal recording material and the humidity determined by the humidity sensing means is higher than a normal humidity value.

5. A toner image fixing device as defined in claim 2, wherein the control means is capable of controlling selectively the sheet separating portion driving means to turn each separating portion into its contacting position or detached position under the condition that the recording material is identified as thick paper thicker than normal recording paper by the recording material identifying means and the humidity determined by the humidity sensing means is higher than a normal humidity detected by the humidity sensing means.

6. A toner image fixing device for fixing by heating a toner image formed on a recording material passing through a nip between paired fixing rollers, wherein the toner image fixing device is provided with paired sheet separating portions, each sheet separating portion being capable of changing position from a contacting position in which the sheet separating portion is in contact with a cylindrical surface of the corresponding fixing roller for separating the recording material from the cylindrical surface, to a detached position being apart from the cylindrical surface of the fixing roller and vice versa, a sheet separating portion driving means for turning the sheet separating portion into the contacting position or the detached position, a humidity sensing means for measuring humidity, a recording material identifying means for identifying a kind of recording material, and a control means for controlling the sheet separating portion driving means based on, at least, either one of the humidity and the kind of the recording material, which are determined by the humidity sensing means and the recording material identifying means, respectively, wherein the control means controls the sheet separating portion driving means to turn the sheet separating portions into the detached positions apart from the corresponding fixing roller surfaces on condition that the kind of the recording material determined by the recording material identifying means is a transparent film sheet.

* * * * *